United States Patent [19]

Mankau

[11] Patent Number: 4,848,786

[45] Date of Patent: Jul. 18, 1989

[54] SKI WITH BALANCING ELEMENTS

[76] Inventor: Dieter Mankau, Seumestr. 11, 6000 Frankfurt/Main, Fed. Rep. of Germany

[21] Appl. No.: 37,260

[22] PCT Filed: Aug. 1, 1986

[86] PCT No.: PCT/DE86/00314

§ 371 Date: Apr. 2, 1987

§ 102(e) Date: Apr. 2, 1987

[87] PCT Pub. No.: WO87/00763

PCT Pub. Date: Feb. 12, 1987

[30] Foreign Application Priority Data

Aug. 3, 1985 [DE] Fed. Rep. of Germany ..... 3527996

[51] Int. Cl.[4] ..... A63C 5/07

[52] U.S. Cl. ..... 280/602

[58] Field of Search ..... 280/602, 608, 609, 601

[56] References Cited

U.S. PATENT DOCUMENTS

| | | | |
|---|---|---|---|
| 1,998,702 | 4/1935 | Boline | 280/609 |
| 3,326,564 | 6/1967 | Heuvel | 280/602 |
| 4,592,567 | 6/1986 | Sartor | 280/602 |

FOREIGN PATENT DOCUMENTS

| | | | |
|---|---|---|---|
| 7171397 | 9/1965 | Canada | 280/609 |
| 721171 | 11/1965 | Canada | 280/609 |
| 102653 | 3/1984 | European Pat. Off. . | |
| 1428966 | 1/1969 | Fed. Rep. of Germany | 280/602 |
| 1578852 | 3/1971 | Fed. Rep. of Germany . | |
| 1603002 | 8/1971 | Fed. Rep. of Germany . | |
| 3147140 | 6/1983 | Fed. Rep. of Germany . | |
| 3331214 | 3/1985 | Fed. Rep. of Germany . | |
| 1163480 | 9/1958 | France . | |
| 2042420 | 2/1971 | France . | |
| 2195466 | 3/1974 | France . | |
| 82569 | 10/1953 | Norway | 280/602 |
| 408734 | 9/1966 | Sweden | 280/609 |

*Primary Examiner*—Charles A. Marmor
*Assistant Examiner*—Tamara L. Finlay
*Attorney, Agent, or Firm*—Michael J. Striker

[57] ABSTRACT

The ski has a box-shaped, substantially rigid middle portion, a front portion and a rear portion which can be easily bent and are elastic and resilient in an upward direction and are capable of torsion in the longitudinal axis. Balancing elements formed of soft, but permanently elastic material, are inserted at the transition of the middle portion to the rear portion in the direction of the rear end of the ski, on the one hand, and/or at the transition of the middle portion to the front portion in the direction of the tip of the ski on the other hand. The balancing elements are inserted in the ski so as to be either not detachable or fixed, but detachable and exchangeable.

11 Claims, 5 Drawing Sheets

FIG. 1
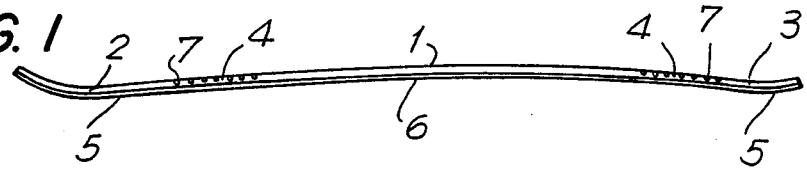
FIG. 2
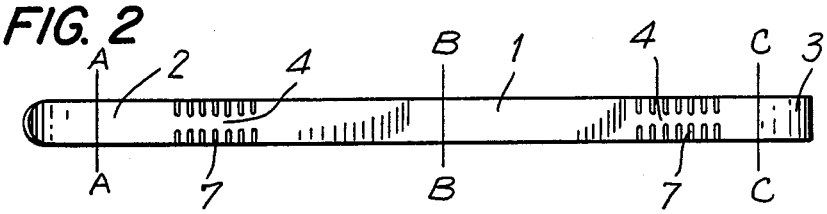
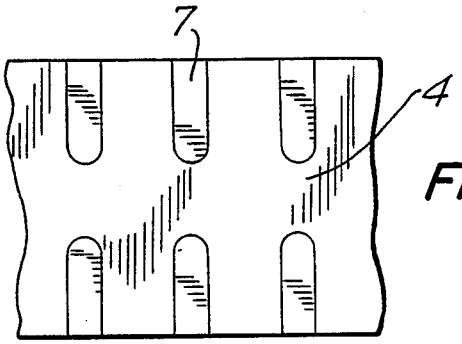
FIG. 3
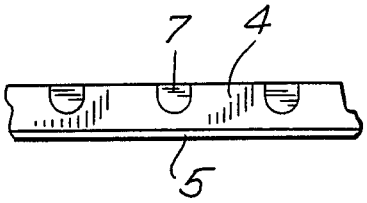
FIG. 4
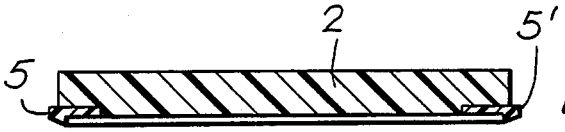
FIG. 5

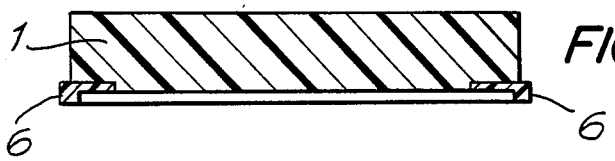
FIG. 6
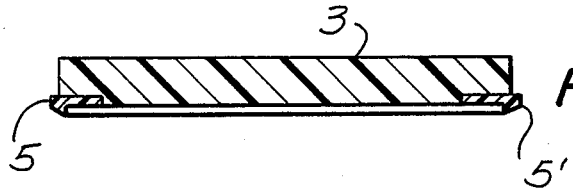
FIG. 7
FIG. 8
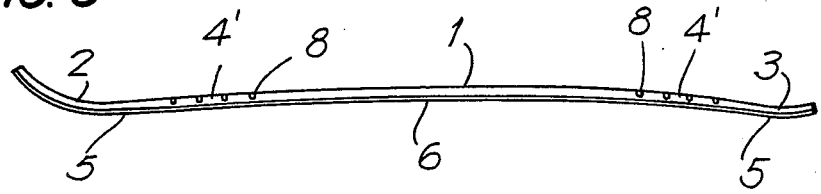
FIG. 9
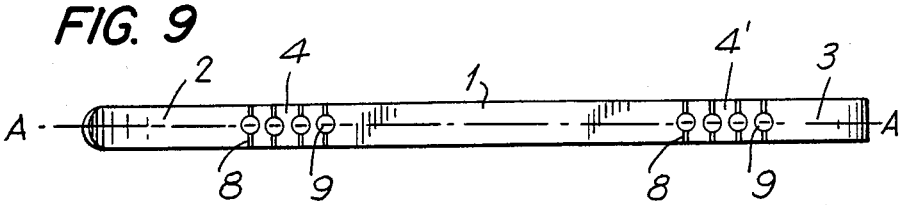
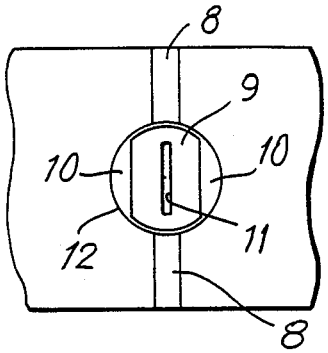
FIG. 10
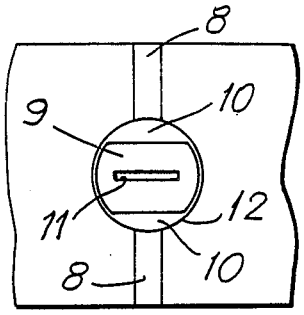
FIG. 11

FIG. 21
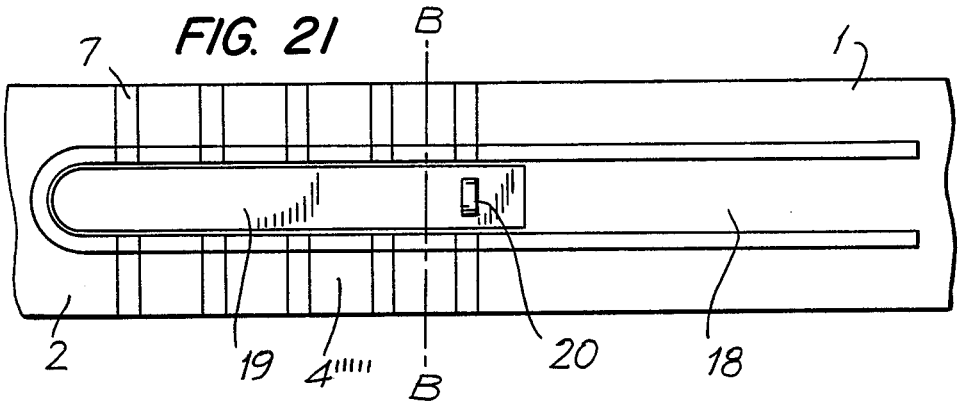
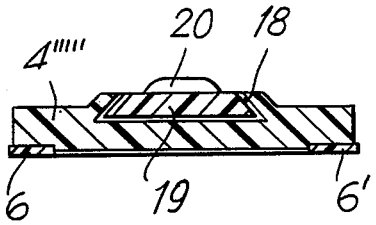
FIG. 22
FIG. 23
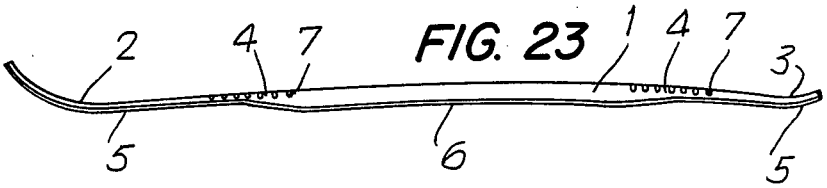
FIG. 24
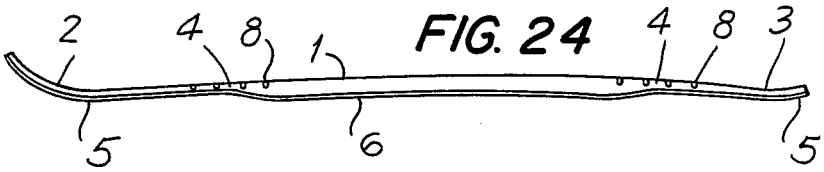

SKI WITH BALANCING ELEMENTS

BACKGROUND OF THE INVENTION

The invention pertains to an Alpine ski for use in the various disciplines of skiing (downhill skiing, slalom, giant slalom, cross-country skiing, ski-hiking, etc.), for the various types of slopes (prepared and unprepared ground, deep snow, rutted slopes, etc.) and for different types of snow (powder snow, wet snow and slush, crusted snow, hard slopes, iced slopes, etc.).

With the exception of actual sporting events, where the participants can select a ski which is specifically designed for the actual course or the discipline at hand and can, in addition, also select a ski which appears specifically suited to the character of the slope and type of snow, e.g. in downhill racing, the availability of a ski which is usable universally, i.e. a ski which travels easily and surely regardless of the respective type of skiing being practiced, different ground formations, different types of slopes, different kinds of snow and different character of the slopes, is a problem for skiers and, accordingly, also for ski manufacturers. Thus, for downhill skiing on prepared and possibly also hard slopes, for example, the ski must lie so as to be free of fluttering and so as to have good grip, but, at the same time, so as to be easily rotatable during turning and rapid fanning movements. In deep snow the ski must avoid "cutting in" by means of an elastic, softer upwardly curved portion or tip and must ensure the necessary lift. The required gripping during lateral turning, arc movement and fanning movements must be ensured while simultaneously avoiding as much as possible the risk of tilting, which occurs particularly on the outside of the ski. The need for a universally usable ski in the aforementioned sense is especially clear in cross-country skiing, where the skier comes across different ground formations, types of snow, types of slopes, etc.

Special problem areas of such a ski are the front portion until the transition to the tip, as well as the rear portion. That is, the front portion must be relatively soft and must be flexible or elastic in the vertical direction, but have high restoring force at the same time, while the restoring time is eliminated to a great extent.

Almost all ski manufacturers have already tried to provide such universally usable skis. The most various materials or combinations of material (plastic, wood, metal, combinations of various plastics, plastic/metal combinations, etc.) and also different thickness (heights) of the skis have been chosen for this purpose. However, all known constructions have the disadvantage that the selected material or the combinations of material and the respective construction can not be varied; that is, they cannot be adapted to the different given factors of the ski course. To the extent that some of the producers have used a construction with medium hardness/flexibility of the front portion and/or the rear portion of the ski as a compromise, particularly unsatisfactory traveling characteristics occur on hard downhill slopes. At the same time, such skis are too hard or not elastic enough for powder snow slopes and particularly in deep snow. The skis which are designed so as to be harder are indeed suitable for a downhill running on prepared and particularly hard slopes, but for this reason they are that much less suitable on unprepared ground and particularly in deep snow. Insofar as the softest possible combination was selected as a compromise, particular disadvantages occurred in the form of the risk of fluttering, unsatisfactory guiding during downhill running, slalom and turning/fanning on prepared, firm slopes. The short skis, which were offered as alternatives, and also the so-called medium-size skis, have easy movability and ease of rotation on soft slopes or slopes with a layer of powder snow. However, they have unsatisfactory traveling characteristics on slopes with packed snow, and especially on iced slopes. On the other hand, the behavior of longer skis in deep snow traveling is unsatisfactory.

SUMMARY OF THE INVENTION

The invention has the object of providing a ski of the type named in the beginning, in which, while avoiding the disadvantages of the known constructions, easy and sure movability is achieved on different ground, different slopes, and under different snow conditions and in the various disciplines of skiing.

This and other objects are attained by a ski including balancing elements formed of soft but permanently elastic material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a side view of the skis, according to the invention, with balancing elements which are embedded in the front and rear portions and are not adjustable;

FIG. 2 is a top view of the ski according to FIG. 1;

FIG. 3 is a top view of a section of the front and rear portions of the ski provided with balancing elements, shown as a detail of FIG. 2;

FIG. 4 is a side view of the detail according to FIG. 3;

FIG. 5 is a section through the front portion of the ski according to FIGS. 1 and 2 at interface A/A;

FIG. 6 is a section through the middle portion of the ski according to FIGS. 1 and 2 at interface B/B;

FIG. 7 is a section through the rear portion of the ski according to FIGS. 1 and 2 at interface C/C;

FIG. 8 is a side view of the ski, as in FIG. 1, but with additional adjustable balancing elements embedded in the middle in the top side of the ski;

FIG. 9 is a top view of the ski according to FIG. 8;

FIG. 10 is a balancing element in the "soft" position shown as a detail of FIG. 9;

FIG. 11 is a balancing element in the "hard" position shown as a detail from FIG. 9;

FIG. 21 shows the ski, according to FIG. 20, but with the stiffening strips in the state in which they are slid in in the area of the balancing elements, in a detailed top view;

FIG. 22 is a cross section through the ski according to FIGS. 20 and 21 at the interface B/B according to FIG. 21;

FIG. 23 shows the ski according to FIGS. 1 and 2, but with front and rear portions which recede in height relative to the middle portion of the ski on the underside (running surface side); and FIG. 24 is a side view of the ski, according to FIG. 23, but with additional adjustable balancing elements according to FIGS. 8–22.

DETAILED DESCRIPTION OF THE PREFERRED EMBODIMENTS

Figure 12:
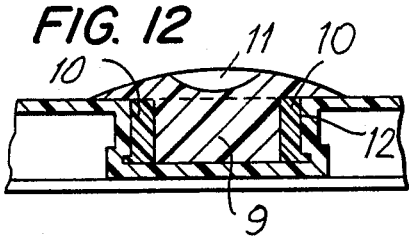
FIG. 12 is a sectional view of the adjustable balancing element in the position according to FIG. 10, shown as a detail of FIG. 9 at the interface A/A.
Figure 13:
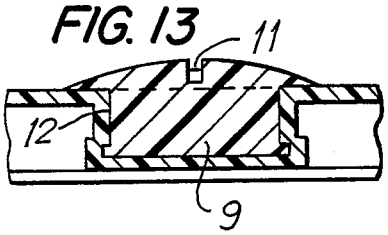
FIG. 13 is a sectional view of the adjustable balancing element in the position according to FIG. 11 at interface A/A, shown as a detail of FIG. 9.

The ski, according to the invention, includes the middle portion 1, the front portion 2 and the rear portion 3. The middle portion 1 is box-shaped (rectangular cross section, trapezoidal cross section, curved upper side). In FIG. 6, the box-shaped middle portion is shown with a rectangular cross section. The middle portion is inherently substantially rigid because of this shape and correspondingly selected material. It comprises guide edges 6, 6′ which are attached in a known manner to the outsides of the running surface of the ski at right angles. The front portion 2 and also the rear portion 3 of the ski are thinner (height) than the middle portion 1 and have guide edges 5, 5′ on the outsides of the running surface which, in contrast to the guide edges 6, 6′ of the middle portion 1, are beveled outward from the plane of the running surface in an upward direction, advisably at an angle of approximately 10°, as shown in FIGS. 5 and 7.

In contrast to the middle portion 1, the front portion 2 and the rear portion 3 can be easily bent and are elastic and resilient in an upward direction along the vertical line, as well as being capable of torsion in the longitudinal axis, in their basic construction, i.e. without the balancing elements 7, 8, 9/10, 13, 15/16 or 18/19, which are described in the following. The length ratio of the middle portion 1, the front portion 2 and the rear portion 3 relative to one another preferably is approximately 3:2:1.

In the embodiment form according to FIGS. 1–4, balancing elements 7, which are made of soft, but permanently elastic material, such as soft plastic, silicon, rubber, or the like, are inserted from the upper side of the ski in the area 4 of the front portion and rear portion of the ski at the two outer sides. These balancing elements 7 dampen and prevent excessive vertical movements of the front portion 2 of the ski with the tip and/or of the rear portion 3; on the other hand, the front and rear portions spring back rapidly into the neutral position. Quantity, width and height of the balancing elements, as well as their degree of hardness, are to be selected while taking into account the material of the ski and its stiffness. According to the invention, the balancing elements can also be securely, but detachably inserted in the ski and can accordingly be exchangeable.

In a further development of the invention, the balancing elements 8 are attached in the areas 4′ of the front portion 2 and the rear portion 3 of the ski, and additional, adjustable balancing elements 9/10 are attached in the surface of the ski, in the middle, between two balancing elements 8, which are located opposite one another, in each instance, in the embodiment form of the ski, as shown in FIGS. 8–11. The balancing elements 8 substantially correspond to the balancing elements 7 described above; they are only adapted at their ends to the shape of the balancing element 9/10. As shown in FIGS. 9–13, the balancing element 9/10, in its entirety, has a circular shape. Its part 9 is formed of hard, inelastic material, e.g., hard plastic, metal, or the like; this part 9 extends in area over the major portion of the circular surface and is defined on 2 sides by the circumference of the circle. Circular segments, made on two opposite sides, form the parts 10 of the balancing element and consist, in turn, of soft, permanently elastic material like the balancing elements 7 or 8 and are permanently connected with the part 9. The balancing elements 9/10 advisably have a rotating slot 11 on the surface in part 9. The balancing elements 9/10 are inserted in the recesses 12, which are embedded in the surface of the ski, so as to be flush with them, but so as to be rotatable in the horizontal plane. In the position of the balancing element 9/10 which is seen in FIG. 10, the soft, permanently elastic parts 10, together with the balancing elements 8, cooperate with the ski. In the position seen in FIG. 11, the part 9 of the balancing element produces a secure connection of the ski surface which corresponds substantially to that of the embodiment according to FIGS. 1–4.

Figure 14:
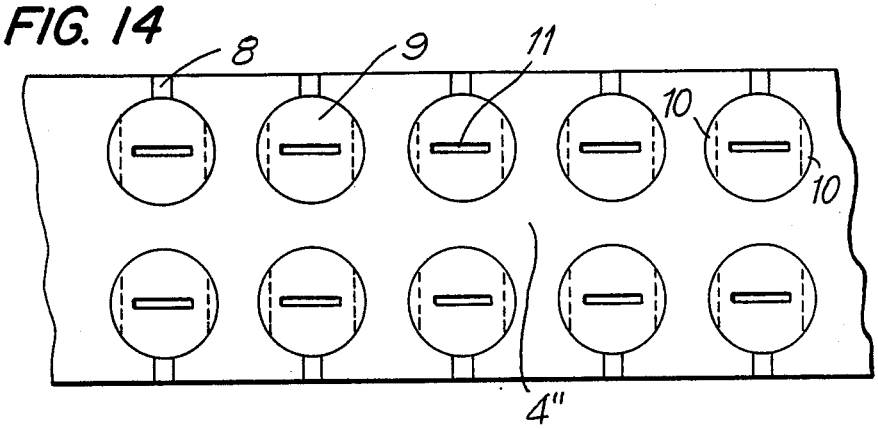
FIG. 14 is a top view of the area of the front and rear portions of the ski with balancing elements, as a detail of FIG. 9, but with 2 rows of the adjustable balancing elements inserted on the upper side of the ski.

Also in a further development of the invention, as shown as a detail in FIG. 14, two parallel rows of the adjustable balancing elements 9/10, each of which is connected to a balancing element 8, are attached in the area 4″ of the front portion 2 and rear portion 3 of the ski.

Figure 15:
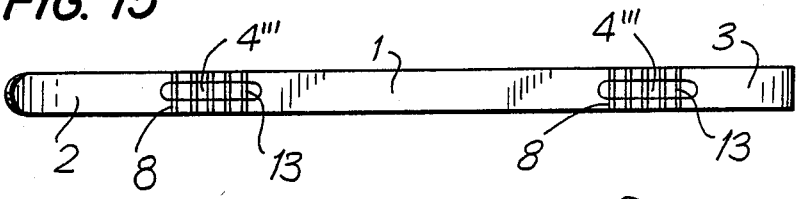
FIG. 15 is a top view of the ski, according to the invention, according to FIGS. 1 and 2, with removable additional balancing elements inserted in the upper side of the ski between the balancing elements, according to FIG. 3, in the front and rear portions.
Figure 16:
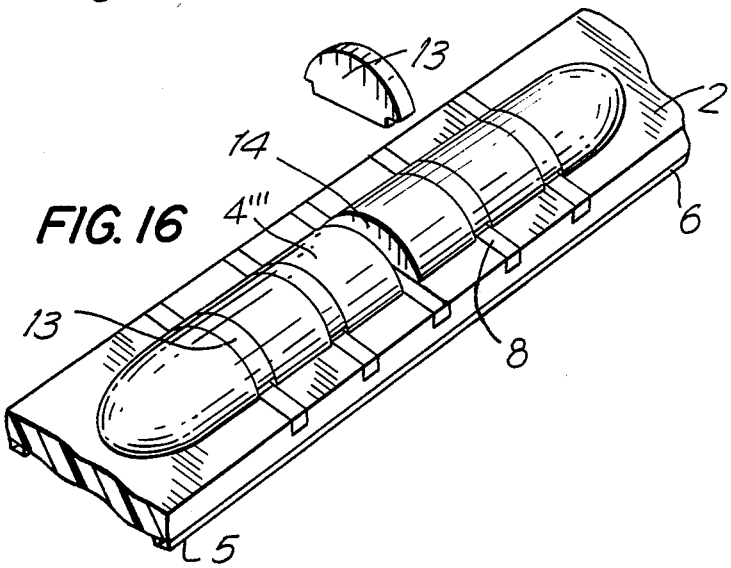
FIG. 16 is a perspective view of the area of the front and rear portions of the ski with 4 inserted and 1 removable additional balancing elements, as a detail of FIG. 15.

Also in a further development of the invention, in the embodiment form according to FIGS. 15 and 16, the balancing elements 13, instead of the balancing elements 9/10, are inserted in the middle, in the front portion 2 and the rear portion 13 of the ski in the areas 4‴, in recesses 14 on the surface of the ski so as to be flush, but so as to be removable; these recesses 14 pass into the described balancing elements 8 laterally. The balancing elements 13 can be soft and permanently elastic like the balancing elements 8, as needed, but can also have a greater degree of hardness up to the point of firm, inelastic material. This embodiment also makes it possible to insert balancing elements 13 of varying degrees of hardness in the individual recesses 14 of the front portion and/or the rear portion of the ski, or also to select an outfitting in the front portion which is different than that of the rear portion.

Figure 17:
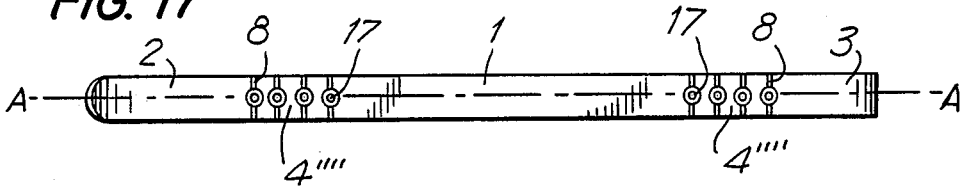
FIG. 17 is a top view of the ski, according to FIGS. 1 and 2, but with balancing elements which are embedded in the middle of the upper side of the ski and are adjustable by means of compressed-air ducts.
Figure 18:
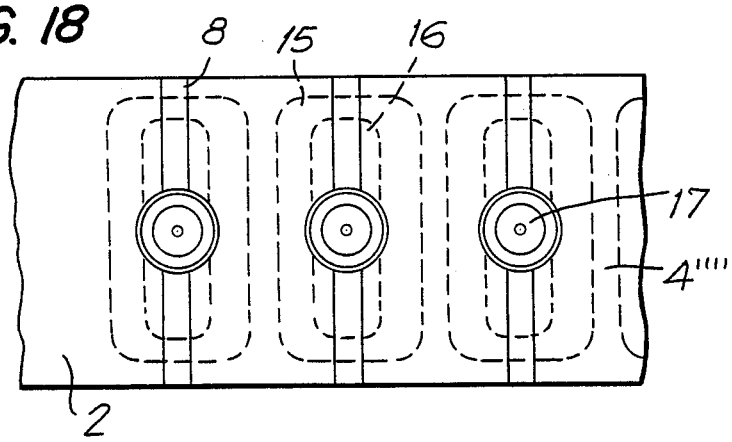
FIG. 18 is a top view/phantom view of the balancing elements, shown schematically, as a detail of the ski according to FIG. 17.
Figure 19:
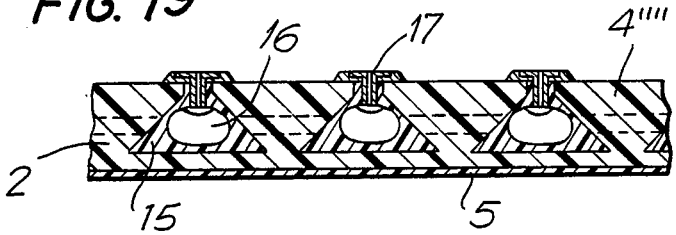
FIG. 19 is the detail, according to FIG. 18, in a side view, at the interface A/A of FIG. 17.

In a further development of the invention, FIGS. 17–19 show an embodiment in which, instead of the balancing elements 9/10 in FIGS. 8–13, balancing elements 15 of soft, permanently elastic material, which is also airtight and impermeable to fluid, are embedded in the areas 4'''' of the front portion and rear portion of the ski in the transverse direction and comprise a chamber 16. This chamber 16 is filled with compressed air or a liquid, e.g. hydraulic oil, which via a valve is introduced from the upper side of the ski, wherein the pressure is maintained as needed and the degree of damping is determined accordingly. The balancing element 15 adjoins the balancing elements 8 on the upper side of the ski on the outside, but can also form a unit with them. Instead of the shown balancing elements 15, which are independent from one another, a plurality of such balancing elements can be provided, according to the invention, with chambers 16 which are interconnected by means of tubes and in which the air or liquid can change from one chamber 16 to the other, according to the operating pressure, when using the skis.

Figure 20:
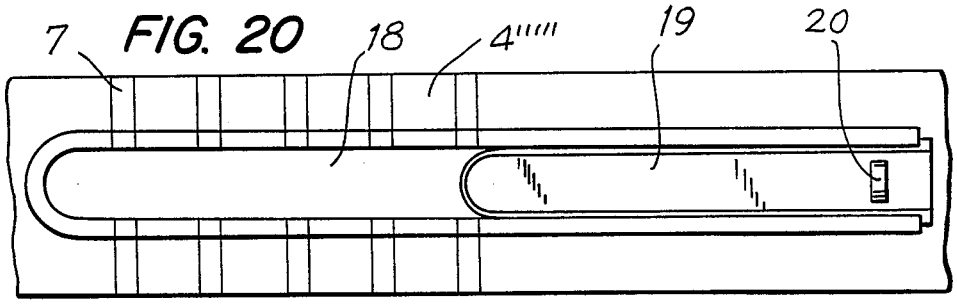
FIG. 20 shows the ski, according to FIGS. 1 and 2, but with stiffening strips which are embedded in the upper side of the ski in the middle, are adjustable in the longitudinal direction of the ski and are shown in the state in which they are pulled out of the area of the balancing elements, as detailed top view.

In FIGS. 20–22, as another embodiment of the ski, according to the invention, the guide rail 18 is embedded in the longitudinal direction of the ski, in the middle, in the areas 4''''' of the front portion 2 and the rear portion 3 in the upper side of the ski between the balancing elements 7 lying on the outsides, the sliding strip 19 being inserted in the guide rail 18 so as to be flush with the control handle 20, but so as to be displaceable in the longitudinal direction. The length of the guide rail 18 is dimensioned in such a way that the sliding strip 19 can be completely slid in over the area 4''''' with the balancing elements 7, but can also, on the other hand, be completely slid out of this area. The sliding strip 19, again, consists, as needed, of softer, more elastic or harder, less elastic material to the point of completely rigid hard material. The sliding strip, which is entirely or partially slid into the guide rail 18 in the area 4''''' cooperates with the balancing elements 7.

The attachment of the balancing elements, described above, in a ski according to the present inventor's German patent application No. P 33 31 214.1 has proven to be another, particularly advantageous embodiment. A ski of this embodiment with the balancing elements 7, according to FIG. 4, is shown schematically in FIG. 23; FIG. 24 shows such a ski with balancing elements 8 and 9/10 or 13 or 15/16.

In all the embodiments of the ski, according to the invention, the balancing elements are arranged from the transition of the middle portion 1 to the front portion 2 in the direction of the tip of the ski, on the one hand, and from the transition of the middle portion 1 to the rear portion 3 in the direction of the rear end of the ski, on the other hand.

The quantity and dimensioning of the balancing elements in the ski, according to the invention, are not rigidly determined. They are geared toward the desired basic design of the ski. Thus, it lies within the framework of the invention to arrange only one pair of balancing elements 7 located opposite one another or one pair of balancing elements 8 located opposite one another, in connection with a balancing element 9/10 lying in between. It also lies within the framework of the invention to use different balancing elements in the front portion 2 of the ski, on the one hand and in the rear portion 3 of the ski, on the other hand, e.g. balancing elements 8, 9/10 in the front portion and balancing elements 7 in the rear portion. In the same way, different balancing elements can be combined in the same area of the front portion of the ski or the rear portion, e.g. balancing elements 7 with balancing elements 8, 9/10 adjoining in the longitudinal direction, or also in alternating combination.

Instead of the round balancing elements 9/10, oval elements consisting of hard, inelastic material can be used in the same way without attached soft, elastic parts 10. It is also conceivable to use conical screw elements as a balancing element, whose balancing action changes according to the screwing-in depth, or also cams.

The ski, according to the invention, has the following advantages over the known ski:

In the basic construction of the ski, the invention makes possible the combination of an extensively rigid middle portion with high torsional strength, on the one hand, with a front portion and a rear portion of the ski which are capable of torsion to a considerable extent and, accordingly, adapt to the respective conditions of the use of the ski in the desired manner. Because of the balancing elements, there occurs a soft, smooth transition from the middle portion to the front portion and rear portion of the ski, wherein, however, the balancing elements ensure high elasticity and, therefore, the return of the front portion and/or rear portion from the "springing in", corresponding to the respective supporting surface, to the original form without a delay factor and make possible a predetermined (defined) torsion.

The achievement of high torsion in the area of the front portion and rear portion of the ski prevents an unwanted excessive catching of the edges, i.e. tilting of the ski, in all kinds of applications and under all conditions of use of the ski, but, at the same time, ensures the necessary degree of edge grip not only in the area of the middle portion, but also in the area of the front and rear portions. Accordingly, the ski is easily rotatable, but, at the same time, also directionally stable on prepared and hard slopes and no fluttering occurs in the ski. The ease of rotation of the ski, according to the invention, is further increased when using the described beveled edges at the front portion and rear portion of the ski.

Another advantage of the ski, according to the invention, which comprises the balancing elements, resides in that the pretensioning of the front and rear portions of the ski can be increased relative to the conventional manner of constructing skis, which, as mentioned, brings about an improved, simultaneously softer ground contact of the front portion and rear portion of the ski and, at the same time, makes possible a strengthening of the edge engagement of the middle portion. By means of using adjustable balancing elements, as shown in FIGS. 10–14 or 17–19, and also in the ski with exchangeable balancing elements, according to FIGS. 15 and 16, as well as in the ski with sliding strip and guide rail, according to FIGS. 20–22, it is possible, by means of a corresponding adjustment or selection of the balancing elements, to give the same ski different stiffness or hardness in the front portion and/or rear portion, depending on the type and place of use, with corresponding adaptation of the traveling characteristics of the ski to ground, type of snow, etc. The ski can likewise be adapted to the body weight of the user. Through the use of one or a plurality of balancing elements, located at the two outer sides of the ski, in each instance, according to FIG. 14, there is the further advantage that a different torsion of the inside and outside of the ski can be achieved.

The ski, according to the invention, thus combines the advantages of long, medium-size and short skis and provides a universally usable ski for the various disciplines of skiing, types of slopes, kinds of snow, etc.

I claim:

1. Ski for use in various types of skiing, on different types of slopes and in different kinds of snow, comprising a middle portion, a front portion and a rear portion, said middle portion arranged to support a ski binding and being box-shaped and substantially rigid, said front portion and said rear portion being constructed so as to be bendable and elastic and resilient vertically upwardly and capable of torsion in a longitudinal axis of the ski; balancing elements formed of soft, but permanently elastic material and inserted in at least one of two areas including an area at a transition of said middle portion to said front portion in the direction of a ski tip and an area at a transision of said middle portion to said rear portion in the direction of a rear end of the ski; and further balancing element (15) formed of soft, permanently elastic material which is also air tight and impermeable to fluids, said further balancing elements each comprising a chamber (16) and being embedded in at least one of the areas (4'''') of said front portion and said rear portion, and said chamber being filled with fluid via valve (17); and means for communicating said chamber (16) of said further balancing elements (15) with one another.

2. Ski according to claim 1, wherein a length ratio of said middle portion, said front portion and said rear portion relative to one another is approximately 3:2:1.

3. Ski according to claim 1, wherein said front portion and said rear portion have each a smaller height than said middle portion.

4. Ski according to claim 1, wherein said first mentioned and further balancing elements (7, 8, 9/10, 13, 15 or 18/19) are attached to the ski only in the area at the transition of said middle portion to said front portion in the direction of said ski tip.

5. Ski according to claim 1, wherein a cross-section of said box-shaped middle portion is rectangular.

6. Ski according to claim 1, wherein said soft but permanently elastic material of said first mentioned balancing elements is soft plastic.

7. Ski according to claim 1, wherein said soft but permanently elastic material of said first mentioned balancing elements is silicon.

8. Ski according to claim 1, wherein said soft but permanently elastic material of said first mentioned balancing elements is rubber.

9. Ski for use in various types of skiing, on different types of slopes and in different kinds of snow, comprising a middle portion, a front portion and a rear portion, said middle portion being substantially rigid while said front portion and said rear portion being constructed so as to be bendable and elastic and resilient vertically upwardly and capable of torsion in a longitudinal axis of the ski; a plurality of balancing elements (15) formed of soft, but permanently elastic material which is air tight and impermeable to fluids, said balancing elements each comprising a chamber and being embedded in at least one of the areas of said front portion and said rear portion; means (17) for filling said chambers (16) of said balancing elements (15) with a fluid; and means for communicating said chambers (16) of said balancing elements (15) with one another.

10. Ski according to claim 9, wherein said means for filling includes a valve (17) provided in at least one of said chambers (16) of said balancing elements (15).

11. Ski according to claim 9, wherein said communicating means includes a plurality of tubes which connect said chambers (16) of said balancing elements (15) with one another.

* * * * *